US012188240B2

(12) United States Patent
Cesana et al.

(10) Patent No.: US 12,188,240 B2
(45) Date of Patent: Jan. 7, 2025

(54) COVERING ELEMENT FOR A FLOOR COVERING

(71) Applicant: Unilin BV, Wielsbeke (BE)

(72) Inventors: Giuseppe Cesana, Fiorano Modenese (IT); Andrea Guglielmi, Fiorano Modenese (IT)

(73) Assignee: Unilin BV, Wielsbeke (BE)

( * ) Notice: Subject to any disclaimer, the term of this patent is extended or adjusted under 35 U.S.C. 154(b) by 702 days.

(21) Appl. No.: 17/257,642

(22) PCT Filed: Jun. 25, 2019

(86) PCT No.: PCT/IB2019/055324

§ 371 (c)(1),
(2) Date: Jan. 4, 2021

(87) PCT Pub. No.: WO2020/008298

PCT Pub. Date: Jan. 9, 2020

(65) Prior Publication Data

US 2021/0285236 A1 Sep. 16, 2021

(30) Foreign Application Priority Data

Jul. 4, 2018 (IT) ..... 102018000006907

(51) Int. Cl.
*E04F 15/02* (2006.01)
*E01C 5/00* (2006.01)
(Continued)

(52) U.S. Cl.
CPC ..... *E04F 15/02161* (2013.01); *E01C 5/00* (2013.01); *E01C 9/00* (2013.01);
(Continued)

(58) Field of Classification Search
CPC ..... E04F 15/0216; E04F 15/02183; E04F 15/02161; E04F 15/02177;
(Continued)

(56) References Cited

U.S. PATENT DOCUMENTS 1,877,481 A * 9/1932 Prouty ..... E04D 1/04 D25/138
3,387,420 A * 6/1968 Long ..... E04D 5/12 428/167
(Continued)

FOREIGN PATENT DOCUMENTS

DE 9105822 U1 9/1991
DE 8716701 U1 2/1998
(Continued)

OTHER PUBLICATIONS

International Search Report and Written Opinion for PCT/IB2019/055324 dated Aug. 7, 2019.
(Continued)

*Primary Examiner* — Brian E Glessner
*Assistant Examiner* — Adam G Barlow
(74) *Attorney, Agent, or Firm* — Troutman Pepper Hamilton Sanders LLP; James E. Schutz; Chris N. Davis

(57) ABSTRACT

A covering element for a floor covering comprising an upper surface having a relief structure, wherein the relief structure comprises excavations having a depth decreasing towards at least one perimetric edge of the covering element.

8 Claims, 3 Drawing Sheets

(51) Int. Cl.
*E01C 9/00* (2006.01)
*E01C 11/24* (2006.01)
*E04F 15/08* (2006.01)
*E04F 15/024* (2006.01)

(52) U.S. Cl.
CPC ..... *E01C 11/24* (2013.01); *E04F 15/02183* (2013.01); *E04F 15/08* (2013.01); *E01C 2201/205* (2013.01); *E04F 15/02447* (2013.01)

(58) Field of Classification Search
CPC ..... E04F 15/02188; E04F 15/08; E01C 2201/205; E01C 5/00; E01C 9/00; E01C 11/24; B28B 11/0863; B28B 7/0082
USPC ..... 52/302.1, 302.3
See application file for complete search history.

(56) References Cited

U.S. PATENT DOCUMENTS 4,381,630 A * 5/1983 Koester ..... E04B 1/7023 D25/155
4,907,387 A * 3/1990 Turnbull ..... E04F 15/02183 52/177
5,475,952 A * 12/1995 O'Connor ..... E04F 15/02172 428/167
5,987,831 A * 11/1999 Lamberts-Van Assche ..... B28B 7/0082 52/311.1
6,055,784 A * 5/2000 Geiger ..... E01C 5/06 52/603
6,058,659 A * 5/2000 Astrom ..... E04F 15/02 52/302.1
6,449,915 B1 * 9/2002 Park ..... E04B 1/70 52/302.1
6,457,288 B2 * 10/2002 Zambelli ..... E04B 5/48 52/444
6,520,471 B2 * 2/2003 Jones ..... E04F 15/02464 52/126.6
7,520,092 B2 * 4/2009 Showers ..... E04F 17/00 52/579
8,365,491 B2 * 2/2013 Schrunk ..... E04F 15/02 428/29
D846,156 S * 4/2019 von Langsdorff ..... D25/113
10,787,812 B2 * 9/2020 Grant ..... B32B 5/245
11,371,248 B2 * 6/2022 Confetti ..... B28B 11/10
2004/0071920 A1 * 4/2004 Ria ..... E04F 15/08 428/44
2004/0086678 A1 * 5/2004 Chen ..... B44C 5/0461 428/44
2005/0129913 A1 * 6/2005 Kobayashi ..... E04F 15/02033 428/167
2005/0204662 A1 * 9/2005 Showers ..... E04F 15/10 52/263
2008/0098689 A1 * 5/2008 Metten ..... B28B 3/021 52/745.19
2008/0276557 A1 * 11/2008 Rapaz ..... E04B 5/48 52/592.1
2010/0101159 A1 * 4/2010 Gleeson ..... E04B 2/707 52/302.1
2012/0317913 A1 * 12/2012 Esquivel ..... B28D 1/30 52/316
2013/0086864 A1 * 4/2013 Marriott ..... E04F 15/02016 52/655.1
2013/0091788 A1 * 4/2013 Lee ..... E04F 15/02161 428/167
2013/0227904 A1 * 9/2013 Amend ..... E04F 15/107 52/309.11
2014/0345222 A1 * 11/2014 Amend ..... E04F 15/185 52/309.1
2016/0319554 A1 * 11/2016 Thiers ..... E04F 15/08
2021/0040746 A1 * 2/2021 Confetti ..... E04F 15/08
2022/0195738 A1 * 6/2022 Confetti ..... B28B 11/0863
2023/0131686 A1 * 4/2023 Weller ..... E04B 5/026 52/578

FOREIGN PATENT DOCUMENTS

DE 202007006447 U1 8/2007
EP 1916080 A2 4/2008
FR 2752251 A1 2/1998
WO WO-9715725 A1 * 5/1997 ..... E01C 11/225
WO 2015024656 A1 2/2015
WO 2017119751 A1 7/2017

OTHER PUBLICATIONS

Search Report for Italian Patent Application No. 201800006907 dated Dec. 12, 2018.

* cited by examiner

COVERING ELEMENT FOR A FLOOR COVERING

CROSS-REFERENCE TO RELATED APPLICATIONS

This application is a National Stage Entry of, and claims priority to, PCT Patent Application No. PCT/IB2019/055324 filed 25 Jun. 2019, which claims priority to Italian Patent Application No. 102018000006907 filed 4 Jul. 2018, the disclosures of both of which are hereby incorporated herein in their entireties.

TECHNICAL FIELD

The present invention relates to a covering element for floor coverings and a floor covering comprising said covering element. In greater detail, the invention relates to a covering element for exterior floor coverings and other substantially horizontal surfaces of exterior structures such as pavements, edges of swimming pools, kerbs, steps, balconies and terraces.

PRIOR ART

As is known, covering elements of horizontal surfaces, such as tiles or slabs usually made of ceramic material, concrete or natural stone, are used in exterior environments of structures, for example balconies, terraces, swimming pools, gardens and courtyards. These covering elements serve to improve the appearance of the environment while also providing a solid and robust floor surface. Evidently, since they are installed in exterior environments, these covering elements are commonly exposed to water, from rain or irrigation systems for example. Consequently the water may stand on the surfaces of the tiles, forming puddles which are not only visually displeasing but may also lead to the formation of mosses on the surface of the covering elements. The water may also make the covering elements more slippery.

This effect is increased in the case of ceramic tiles, especially large tiles, which may not be perfectly flat and which may have a slight concavity favouring the standing of water.

To overcome this problem, US 20130318705 A proposes a system in which the covering elements are installed on the surface to be covered with a predetermined inclination, by using suitable packing pieces placed under the covering elements. Although this system is effective, it is rather complex and costly, and cannot be used in all applications. Furthermore, it forms an inclined, non-horizontal floor surface which may become slippery when wet.

Other solutions, such as that of WO 2008/118007 A1, propose the use of covering elements having through holes which form drainage channels through the whole thickness of the covering element, so that the water does not stand on the surface. This solution can only be used with certain types of material such as cement, and requires a substrate, on which the covering elements are installed, which is also capable of disposing of the water drained from the covering element. Furthermore, these through holes form a major limitation on the visual characteristics of the covering element.

The present invention proposes, in the first place, to provide an alternative covering element which, according to some of its embodiments, is intended to resolve one or more of the problems arising from the prior art. Additionally, one object of the present invention is to overcome the aforesaid drawbacks of the prior art, in the context of a simple, rational and inexpensive solution. These objects are achieved by the characteristics of the invention as stated in the independent claim. The dependent claims identify preferred and/or particularly advantageous aspects of the invention.

DISCLOSURE OF THE INVENTION

A first independent aspect of the invention provides a covering element for a floor covering comprising an upper surface having a relief structure, wherein the relief structure comprises excavations having a depth decreasing towards at least one perimetric edge of the covering element. For example, said excavations comprise a base having an inclination descending towards a perimetric edge of the covering element. It should be noted that the excavations substantially define channels, each having a first and a second end, wherein said second end is located at a lower level than said first end, and wherein said second end is located substantially on a perimetric edge of the covering element. In practice, said excavations form drainage channels for the water. These excavations may also be designed in such a way that the drained water runs along predetermined paths, which not only provide drainage but also improve the appearance of the covering element, giving it an added value. As a result of this solution, a path is substantially defined for the run-off of the water or for any other liquid towards at least one edge of the covering element, so that it does not stand on the upper surface of the element. Thus the water may be conveyed, for example, towards a drain or duct without the need to modify the substrate on which the covering is installed. This solution may also be integrated into substantially any relief structure, or into any pattern of the covering element. Advantageously, the excavations may have open ends on said perimetric edge, to enable the water to drain outside the perimeter of the covering element. The relief structure may also be advantageously free of blind excavations, that is to say excavations having no open ends on an edge, so that the relief structure is free of cavities in which the water may stand. It should be noted that, advantageously, substantially all the excavations of the relief structure have said decreasing depth, to ensure the correct run-off of the water. Evidently, the expression "substantially all the excavations" is taken to mean preferably all the excavations, and in any case the majority of the excavations, where a small minority of said excavations may not have said characteristic, for example in order to provide better adaptation to a graphic design formed by the relief structure. These excavations may also be designed in such a way that the drained water runs along predetermined paths, which not only provide drainage but also improve the appearance of the covering element, giving it a further added value.

According to a preferred aspect of the invention, the excavations of the relief structure have a maximum depth of more than 0.5 mm, preferably more than 0.8 mm, or for example more than 1 mm. In particular, the depth of the excavations may have a fall of more than 0.5 mm, preferably more than 0.8 mm, or for example more than 1 mm.

Additionally, the excavations of the relief structure may preferably have an inclined or curved base, with a substantially continuous slope, or the depth of the excavations may decrease progressively in a substantially continuous way towards the edge of the covering element. However, according to other embodiments, the depth of the excavations may decrease progressively in a substantially discontinuous way towards the edge of the covering element, with a stepped configuration for example.

Preferably, said excavations may have a depth decreasing towards a plurality of edges of the covering element, or some of the excavations may have a depth decreasing towards a first edge, while other excavations may have a depth decreasing towards a second edge of the covering element, for example opposite or adjacent to the first. For example, according to a preferred embodiment, the excavations have a depth decreasing from a first edge towards a second edge of the covering element, the first and the second edge being opposite one another, for example. In other words, the first end of one or more excavations is located on a first edge of the covering element, while the second end is located on a second edge, opposite the first for example, and the second end is located at a lower level than the first end. According to another preferred embodiment, the excavations have a depth decreasing from a central portion of the upper surface towards at least one edge of the covering element, preferably towards a plurality of edges of the covering element, for example towards two opposite and/or adjacent edges, or more preferably towards all the edges of the covering element. Evidently, the expression "central portion of the upper surface" is taken to mean an inner portion relative to the edges or a portion that is remote from the edges, without necessarily being centred relative to the upper surface. Thus the water can be effectively conveyed towards the outside of the covering element from the central area, that is to say from the areas where the water stands more readily, particularly in covering elements that may have concavities, such as ceramic tiles.

Advantageously, according to a preferred embodiment, the excavations of the relief structure are interconnected with one another, or in other words are in fluid communication with one another. This ensures an effective run-off of the water towards the outside of the covering element, since a multiplicity of paths are available for the water. Advantageously, the relief structure may comprise one or more groups of excavations interconnected with one another, in which each group of excavations has a depth decreasing towards at least one respective edge. Thus various groups of paths may be defined to guide the water towards specific edges.

According to another preferred aspect of the invention, the relief structure has peaks located substantially at the same height, forming a floor. In practice, the relief structure comprises a substantially flat surface that forms a substantially horizontal floor in which are made notches and depressions defining the excavations described above. This provides a horizontal floor such that it limits the slipperiness of the upper surface of the covering element while also providing effective water run-off. This also provides a covering element having a substantially flat, non-convex appearance, so that, when a plurality of covering elements are placed side by side, the covering formed by them has a substantially continuous appearance. It should be noted that the expression "substantially flat" is taken to mean that there may be small variations in the height of the peaks, of less than 0.3 mm for example.

It should also be noted that the relief structure of the upper surface of the covering element may comprise excavations and protrusions that are preferably arranged in a predetermined order, but there is no reason why these excavations and protrusions should not be arranged in a random order. Preferably, the relief structure is shaped to represent a wood pattern, that is to say the veining and knots of a wood pattern, a stone or a concrete pattern, a resin or any other design or pattern.

According to an embodiment of the invention, the covering element may comprise a lower surface having a second relief structure. In particular, the second relief structure may have one or more of the characteristics described in relation to the relief structure of the upper surface. Preferably, each surface may represent a specific pattern, so that, during installation, the user can choose which surface is to be visible. For example, the second relief structure may be substantially specular to the relief structure of the upper surface, so that the weight and quantity of material is substantially balanced between the surfaces. This is particularly important for covering elements made of ceramic material or other materials which have to be subjected to heat treatment such as firing, in which the covering element itself is subject to shrinkage phenomena. In fact, the shrinkage phenomena depend on the dimensions of the covering element and on the quantity of material, and the balancing avoids differential shrinkage in the covering element that may lead to dimensional distortions such as curvature of the element. It is to be emphasized that the expression "substantially specular" is taken to mean that it is acceptable to have minor differences, either random or intentional and predetermined, between the relief structure of the upper surface and the second relief structure of the lower surface.

According to the preferred embodiment, the covering element is a ceramic tile or slab, that is to say it comprises a support of ceramic material such as porcelaneous stoneware, monoporous ceramic, white or red body ceramic, maiolica, terracotta or other ceramic powders sintered at high temperature. For example, the covering element is a tile of technical-grade porcelaneous stoneware, that is to say one having low porosity and suitable for exterior applications. It should be noted that, according to other embodiments, the covering element, and particularly its support, may be made of other materials such as wood or wood fibre, for example MDF or HDF (Medium Density Fibreboard or High Density Fibreboard, respectively), or plastic, for example vinyl, preferably PVC, or fibre-cement (an example of fibre-cement is the material known by the trade name of Micodur®). The covering element is preferably rectangular or square in shape, but there is no reason why it should not have a different shape, hexagonal for example.

The covering element has a thickness of between 2 and 30 mm, for example between 7 and 25 mm. According to the preferred embodiment, the covering element is made of ceramic material, for example porcelaneous stoneware, and has a thickness of approximately 20 mm. In fact, this thickness is particularly suitable for exterior applications, where the covering element is frequently not bonded to a substrate, and therefore requires better intrinsic mechanical properties.

According to a preferred embodiment, the upper surface of the covering element has a pattern having various colours, designs or graphic elements. The pattern may simulate a natural material such as a natural stone or wood, or may represent a cement, a resin or any other graphic element. Preferably, the pattern is at least partially formed by a printed graphic element. The printing is preferably carried out using contactless printing methods such as digital inkjet printing or screen printing, since this makes it possible to print in high resolution even on the irregular configuration of a distressed edge. However, there is no reason why other printing techniques such as flexography, offset printing or rotogravure should not be used. Evidently, the pattern may comprise a colour or black and white design, but it may also be formed by solid colouring, in which case other decorative techniques are possible, such as aerography or cascade or film decoration. Additionally, there is no reason why the covering element should not be decorated with a whole body technique, that is to say one in which at least one pigment is mixed, according to a predefined design or in a random manner, with the material forming the support, colouring a part or preferably the whole thickness of the support rather than just its upper surface. Furthermore, there is no reason why the pattern should not be applied to a suitable pre-printed substrate to be fixed to the support, for example a sheet of paper or plastic, PVC for example, particularly where a wood or plastic support is used.

The covering element may also comprise one or more covering layers on the upper surface of the covering element.

For example, the covering layers may comprise a background covering configured to cover the upper surface at least partially, or preferably entirely. Thus the background covering may cover the colour of the support while also waterproofing the support, and it may also be suitable for receiving the pattern on itself, in other words forming the background of the pattern. The background covering may be white, beige, brown, grey or any other colour. According to the preferred embodiment in which the support is made of ceramic material, the background covering preferably comprises a glaze and/or an engobe capable of covering the upper surface of the support. According to other embodiments, however, the background covering may be made of other materials such as fillers or resins, for example melamine or epoxy resin.

The covering layers may also comprise a protective covering that covers the upper surface at least partially, or preferably entirely, and can be placed on top of the pattern to cover and protect it. Advantageously, the protective covering may be transparent or translucent to allow the underlying pattern to be seen. The protective covering may also comprise fillers or additives for imparting new functions and/or improving the surface properties of the decorative layer, for example anti-wear, anti-slip, anti-bacterial or stain-resistant properties. The protective covering may also used in combination with the background covering, or the protective covering may be placed on top of the background covering. According to the preferred embodiment in which the support is made of ceramic material, the protective covering preferably comprises a transparent glaze and/or a granular material. According to other embodiments, however, the protective covering may be made of other materials, preferably resins, for example melamine or epoxy resin.

The relief structure may be formed by various possible methods, three of which are described below by way of non-limiting, non-exhaustive example.

According to a first possible method, the relief structure may be formed in the support of the covering element. In this case, the relief structure may appear through the background covering and/or the protective covering. According to a second possible method, the relief structure may be formed in the background covering and/or in the protective covering, for example on top of an upper surface of the substantially flat support. According to a third possible method, the relief structure may be formed according to the first and second possible methods, or may be formed partially in the support of the covering element and partially in the background covering and/or the protective covering.

A second independent aspect of the invention relates to a set comprising a plurality of covering elements, in which at least one, or preferably each, covering element comprises an upper surface having a relief structure, and in which the relief structure comprises excavations having a depth decreasing towards at least one edge of the covering element. It should be noted that the covering elements of the set may have one or more of the characteristics described in relation to the first independent aspect.

Additionally, according to one embodiment, if two of said covering elements are adjacent, the relief structures are in fluid communication with one another. For example, the depth of the excavations decreases progressively from a first covering element to a second covering element which is adjacent. Thus a plurality of covering elements may be installed so as to define a run-off path for the water that is substantially continuous from one element to another, so as to carry the water into a trough or drain located at a greater distance than the width or length of the covering element.

The set may be used for providing a covering such as a floor covering, preferably for exterior use. In particular, the covering may be a raised floor covering, that is to say one in which the covering elements are supported in a raised position relative to the surface to be covered, for example forming a cavity between themselves and said surface to be covered. For example, the set comprises a supporting element configured to support the covering element in a raised position relative to the surface to be covered, forming a cavity between the element and said surface to be covered. Said cavity may form or comprise a drain flowing out from the covering element. For example, the covering element and/or the supporting element is configured so that, in use, a mutual distance, or passage space, allowing access to said cavity is formed between adjacent covering elements. Preferably, the covering elements are free of linings, rims or fillers. Thus the water resulting from rain or heavy precipitation, for example, may flow into the cavity formed under the covering, thereby avoiding the formation of puddles on the covering itself. For example, the supporting elements may comprise at least one spacer configured to be interposed between the edges of two adjacent covering elements so as to define said mutual distance.

The set may also be used for forming an edge of a swimming pool, the steps of a staircase, a terrace or balcony, a path or pavement, or any other type of floor covering for walking on. It should also be noted that the set may also be used for forming substantially horizontal coverings that are not necessarily for walking on, such as the top of a dwarf wall or an enclosure made of masonry.

A third aspect of the invention, therefore, may relate to a covering as defined above, comprising a plurality of covering elements, in which at least one, preferably each, covering element has one or more characteristics described in relation to the first or second independent aspect.

A fourth independent aspect of the invention also provides a method for manufacturing a covering element having one or more of the characteristics described in relation to the first or second independent aspect. According to this fourth independent aspect, the method includes the steps of:

- providing a half-processed product having an upper surface;
- forming a relief structure on said upper surface of the half-processed product, wherein the relief structure comprises excavations having a depth decreasing towards at least one perimetric edge of the covering element.

According to the preferred embodiment in which the covering element is made of ceramic material, the step of providing the half-processed product comprises the step of providing a green half-processed product; for example, said step of providing comprises the step of:

providing a ceramic composition in powder form and forming said composition into a half-processed product having an upper surface. For example, the step of forming the composition may comprise the steps of pressing, casting or extruding the composition. According to other embodiments in which the covering element is made from other materials, the step of providing may comprise other steps, such as extruding, rolling, moulding or casting the half-processed product, from PVC, cement, artificial stone, laminate, natural stone, or other materials, for example.

The step of forming the relief structure may provide for impressing the relief structure on the upper surface of the intermediate product. For example, this may be done by static or continuous pressing, or by means of a die or a compacting belt having a structured surface substantially representing the negative of the relief structure of the covering element. Alternatively, the step of forming the relief structure may provide for incising the upper surface of the half-processed product, for example by using milling cutters or other tools. According to other embodiments, the step of forming the relief structure may provide for depositing a material on the upper surface of the half-processed product to form the relief structure; for example, this deposition may be carried out by digital printing, flexography, screen printing or other printing methods, or by any other controlled deposition method. Advantageously, the relief structure may be deposited in the form of a covering of a support, for example in the form of the background covering or protective covering as described in relation to the first independent aspect. In fact, the method may comprise the step of applying one or more covering layers on the upper surface of the half-processed product, for example the background covering and/or the protective covering as described in relation to the first independent aspect. This application may take place before or after the step of forming the relief structure.

It should also be noted that the method may provide for forming a relief structure on the lower surface of the half-processed product. Said step of forming the second relief structure may be carried out by the same methods as those of the step of forming the relief structure on the upper surface. Additionally, said step of forming the second relief structure may take place before, after or during the step of forming the relief structure on the upper surface.

The method may also comprise a step of consolidating the half-processed product, particularly the support and/or the covering, to produce the covering element. For example, according to the preferred embodiment in which the covering element is made of ceramic material, the consolidation step comprises at least one step of firing the half-processed product, for example the support and/or the covering. The firing step is preferably carried out at high temperature, for example at a temperature of more than 900° C., for example 1200° C. The consolidation step may comprise any other type of curing or treatment for consolidating the half-processed product, for example heating, drying, ageing or irradiation, for imparting the final properties of the covering element to it.

A fifth independent aspect of the invention provides a die or a compacting belt having a structured surface substantially representing the negative of the relief structure of the covering element. In particular, the structured surface of the die, or of the compacting belt, may be configured to impress on the upper surface of a half-processed product a relief structure having one or more of the characteristics described in relation to the first or second independent aspect.

Further characteristics and advantages of the invention will be apparent from a perusal of the following examples, provided by way of non-limiting example, with the aid of the figures shown on the attached sheets.

DETAILED DESCRIPTION OF THE INVENTION

Figure 1:
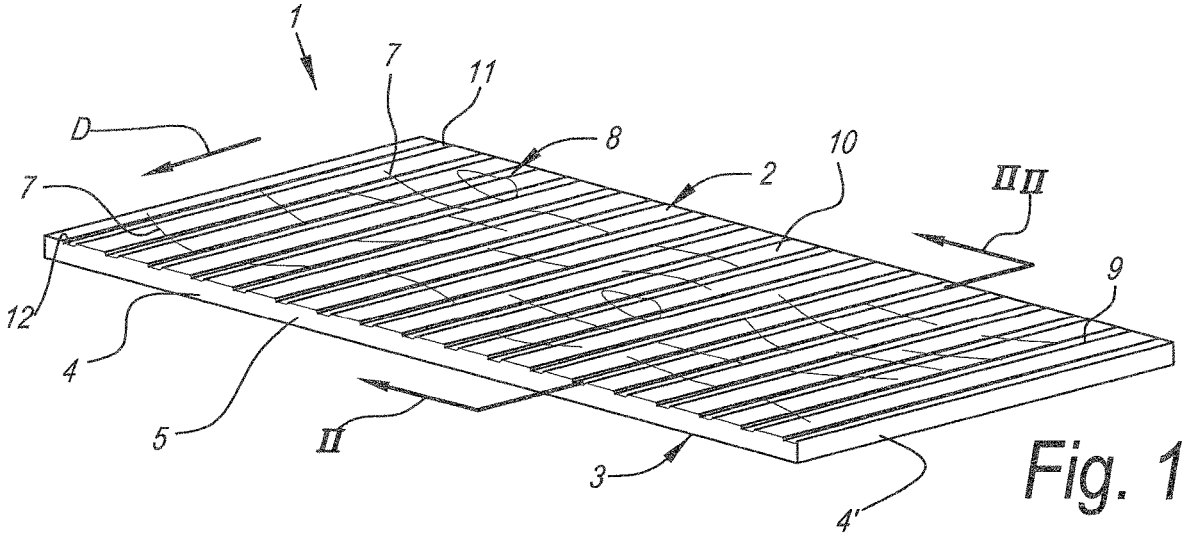
FIG. 1 is an axonometric view of a covering element 1.

FIG. 1 is an axonometric view of a covering element 1. The covering element 1 is rectangular in shape and is substantially flat. The covering element 1 has an upper surface 2 and a lower surface 3, as well as longitudinal side edges 4 and transverse side edges 4'. The upper surface 2 forms a decorative surface of the covering element 1.

In the preferred example shown in the figures, the covering element 1 comprises a support 5 made of ceramic material, for example porcelaneous stoneware. It should be noted that there is no reason why, in other examples, the support 5 should not be made of other materials, for example polymer materials such as PVC, artificial stone, natural stone, laminate or fibre-cement.

The upper surface 2 has a relief structure 8 comprising recesses or excavations 9 and protrusions 10. The excavations 9 are open on the side edges 4 of the covering element 1. In the embodiment shown in FIG. 1, the excavations 9 are transverse grooves. The excavations 9 substantially define channels, each having a first and a second end 11, 12, wherein said second end 12 is located substantially on a longitudinal side edge 4 of the covering element 1. Additionally, said second end 12 is located at a lower level than said first end 11. Thus the water or any other fluid that may be deposited on the upper surface 2 of the covering element 1 would run off by gravity from said upper surface 2 in the run-off direction D from the first end 11 to the second end 12 of the excavations.

In the example of FIG. 1, the run-off direction D extends from one longitudinal edge 4 towards the opposite longitudinal edge 4.

Figure 2:
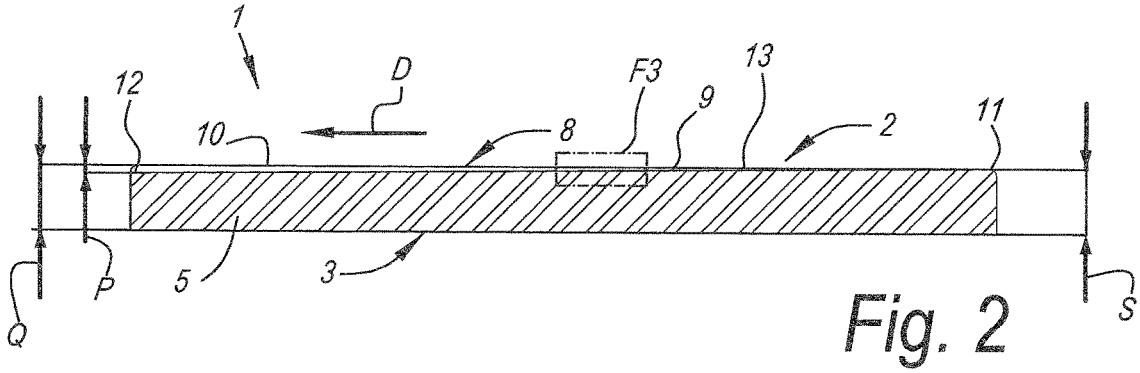
FIG. 2 is an enlargement of the cross section taken through the plane II-II of FIG. 1.

FIG. 2 is an enlargement of the cross section taken through the plane II-II of FIG. 1.

The covering element 1 has a thickness S of between 5 and 30 mm, preferably 20 mm.

The excavations 9 have a depth P that decreases towards one of the side edges 4 of the covering element 1; that is to say, the depth P of the excavations 9 is smaller at the first end 11 and greater at the second end 12. For example, the bases of said excavations have an inclination that descends towards a perimetric edge 4 of the covering element 1, that is to say from the first to the second end 11, 12. Said inclination is indicated in FIG. 1 by the angle I.

The depth P may reach maximum values of more than 0.5 mm, or preferably more than 0.8 mm, for example more than 1 mm. In particular, the depth of the excavations may have a fall, that is to say the difference between the depths of the first and second end 11, 12, of more than 0.5 mm, or preferably more than 0.8 mm, for example more than 1 mm.

The protrusions 10 of the relief structure comprise peaks (or vertices) 13 located substantially at the same height, forming a floor. In practice, the peaks 13 are located at the same height Q relative to the lower surface 3 of the covering element 1.

Figure 3:
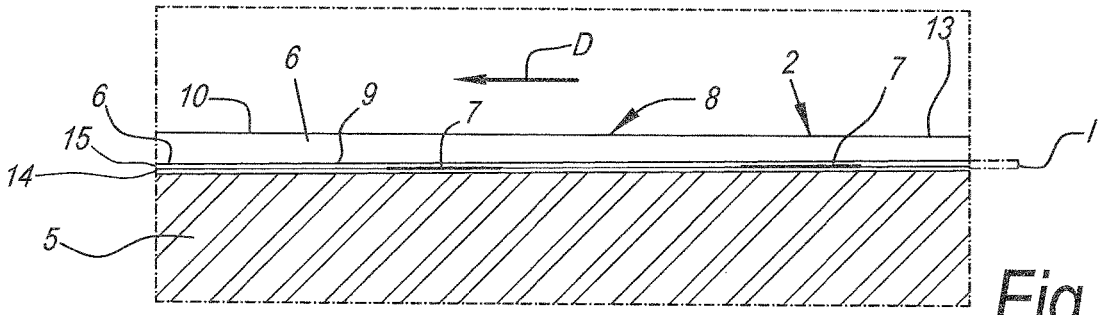
FIG. 3 is an enlargement of the cross section indicated by F3 in FIG. 2.

FIG. 3 shows an enlargement of the cross section indicated by F3 in FIG. 2.

The covering element 1 comprises a covering 6 of the upper surface 2, particularly a covering that can cover the upper surface of the support 5.

The covering 6 comprises a background covering 14 and a protective covering 15 placed on top of the background covering 14. The background covering 14 comprises, for example, a uniformly coloured glaze capable of covering the colour of the support 5 and providing a background colour for a pattern 7. The protective covering 15 is preferably a transparent or translucent glaze which protects the pattern 7 while still providing visibility. Additionally, according to the embodiment shown in FIG. 3, the pattern 7 comprises a print, for example a digital print, applied on the background covering 14 and under the protective covering.

In the example shown in FIG. 3, the relief structure 8 is formed in the support 5 and appears through the covering 6.

Figure 4:
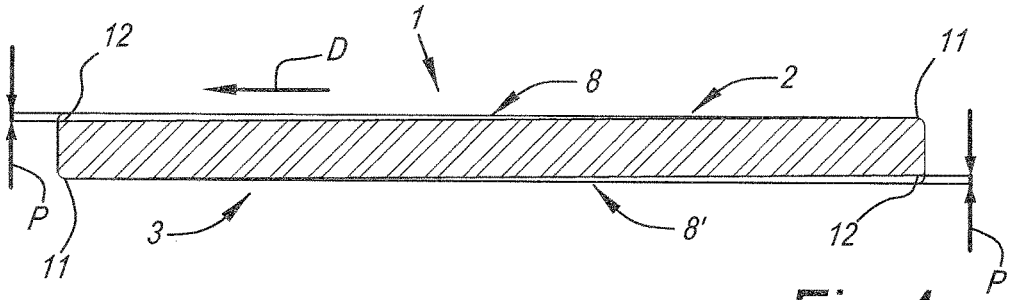
FIG. 4 is an enlargement of the cross section taken through the plane II-II of FIG. 1 in an alternative embodiment.

FIG. 4 is an enlargement of the cross section taken through the plane II-II of FIG. 1 in an alternative embodiment.

In the embodiment shown in FIG. 4, the lower surface 3 of the covering element 1 comprises a second relief structure 8'. In the illustrated example, the second relief structure 8' is substantially specular to the relief structure 8 of the upper surface 2.

Figure 5:
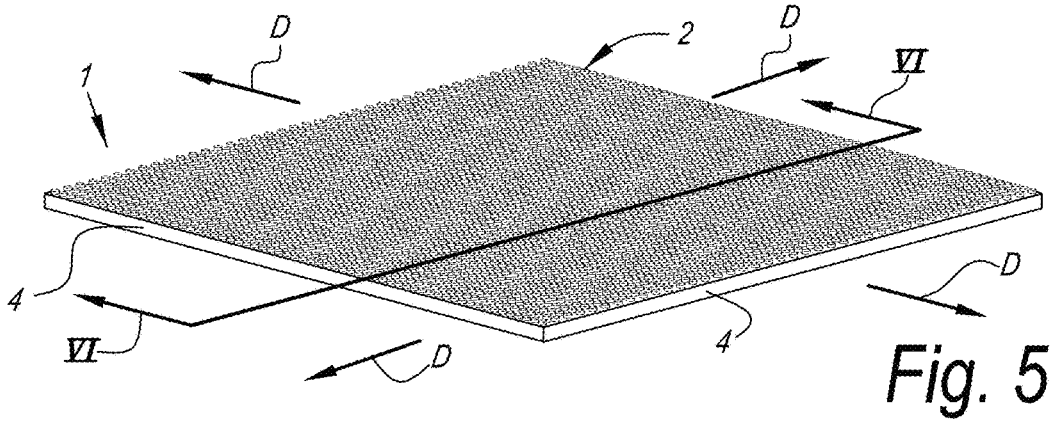
FIG. 5 is an axonometric view of a covering element according to a further embodiment.

FIG. 5 is an axonometric view of a covering element 1 according to an alternative example, in which the run-off direction D extends from a central portion of the covering element 1 to the side edges 4, in a substantially radial manner.

In the illustrated example, the relief structure 8 is formed by a plurality of protrusions 10 of substantially cylindrical shape, equidistant from one another, while the excavations 9 are defined by the spaces between said protrusions. The bases of said excavations 9 are inclined from the central portion to the side edges 4 of the covering element 1.

It should also be noted that, according to the embodiment shown in FIG. 5, the excavations 9 are interconnected with one another with fluid communication; that is to say, a fluid can flow freely from one excavation 9 to another. In fact, according to the example, the spaces between the protrusions 10 form a grid of excavations 9 allowing the water to run off.

Figure 6:
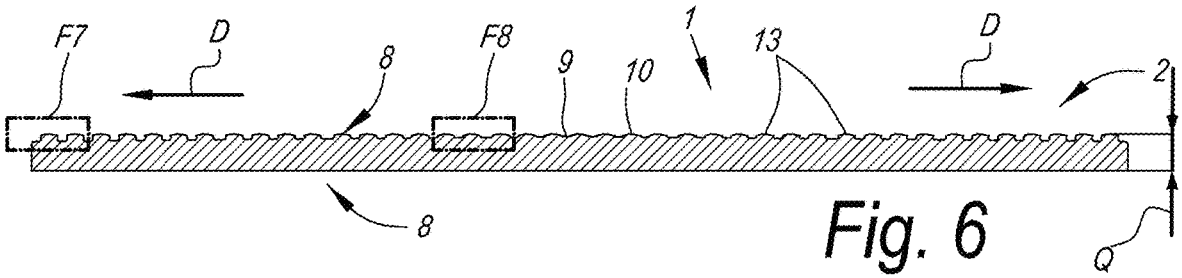
FIG. 6 is an enlargement of the cross section taken through the plane VI-VI of FIG. 5.
Figure 7:
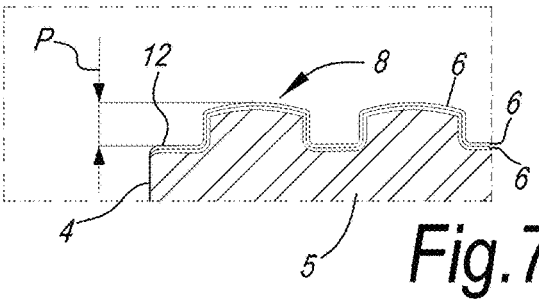
FIG. 7 is an enlargement of the cross section indicated by F7 in FIG. 6.
Figure 8:
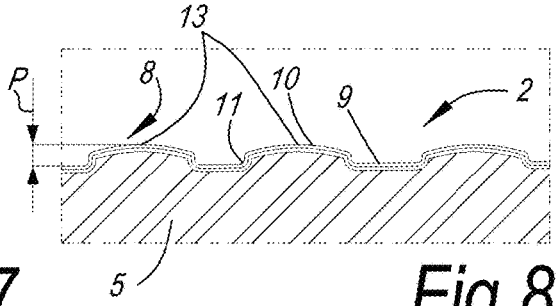
FIG. 8 is an enlargement of the cross section indicated by F8 in FIG. 6.

FIG. 6 is an enlargement of the cross section taken through the plane VI-VI of FIG. 5.

The excavations 9 have a depth P that decreases from a central portion of the upper surface 2 towards opposite side edges 4 of the covering element 1. In other words, the base 13 of each of the excavations 9 has an inclination I descending towards a respective perimetric edge 4 of the covering element 1. Here again, the first end 11 of each of the excavations 9 is placed near the central portion of the covering element 1, while the second end 12 is located on a respective side edge 4.

FIG. 6 is an enlargement of the cross section taken through the plane II-II of an alternative covering element of FIG. 1.

Figure 9:
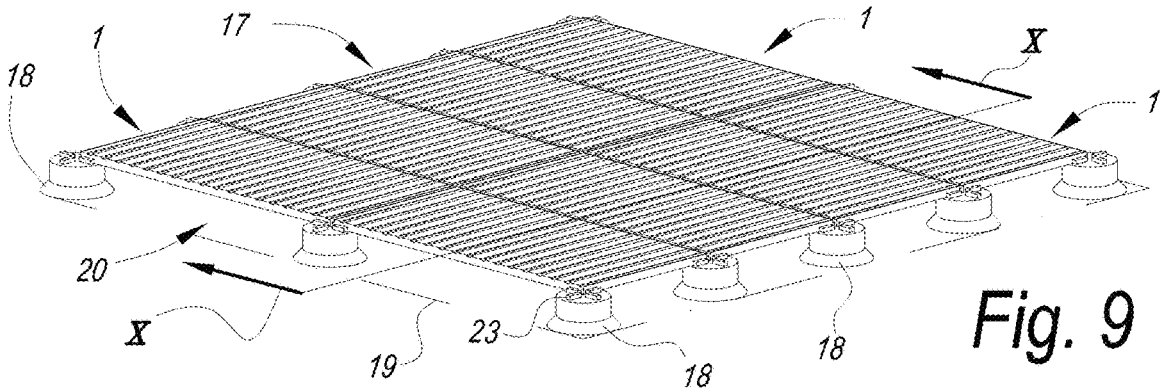
FIG. 9 is an axonometric view of a raised floor covering comprising a plurality of the covering elements of FIG. 1.

FIG. 9 is an axonometric view of a raised floor covering 17 comprising a plurality of the covering elements 1 of FIG. 1.

The raised floor covering 17 comprises supporting elements 18 capable of keeping the covering elements 1 raised relative to an underlying surface 19 so as to form a cavity 20 where the water running off the covering elements 1 can be collected. The supporting elements 18 include spacers 23 located on the upper surface of the supporting elements 18 which are interposed between the edges of two adjacent covering elements.

Figure 10:
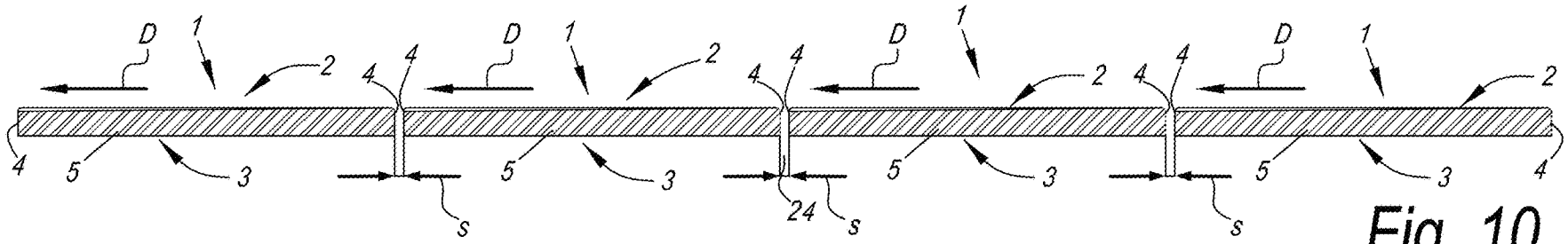
FIG. 10 is an enlargement of the cross section taken through the plane X-X of FIG. 9.

FIG. 10 is an enlargement of the cross section taken through the plane X-X of FIG. 9.

The side edges 4 of two adjacent covering elements 1 are located at a distance S from one another so as to define a passage space 24 allowing access to the cavity 20, so that the water can flow from the upper surface 2 to the cavity 20.

Figure 11:
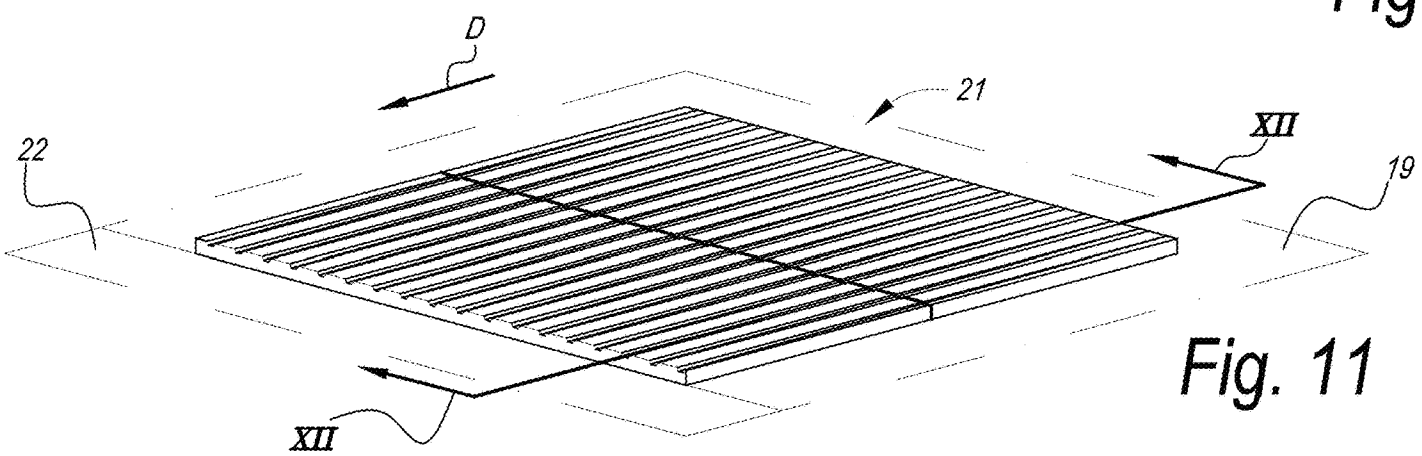
FIG. 11 is an axonometric view of a set comprising at least a pair of covering elements according to the example shown in FIG. 1.

FIG. 11 is an axonometric view of a set 21 comprising at least a pair of covering elements 1 and 1' according to the example shown in FIG. 1.

Figure 12:
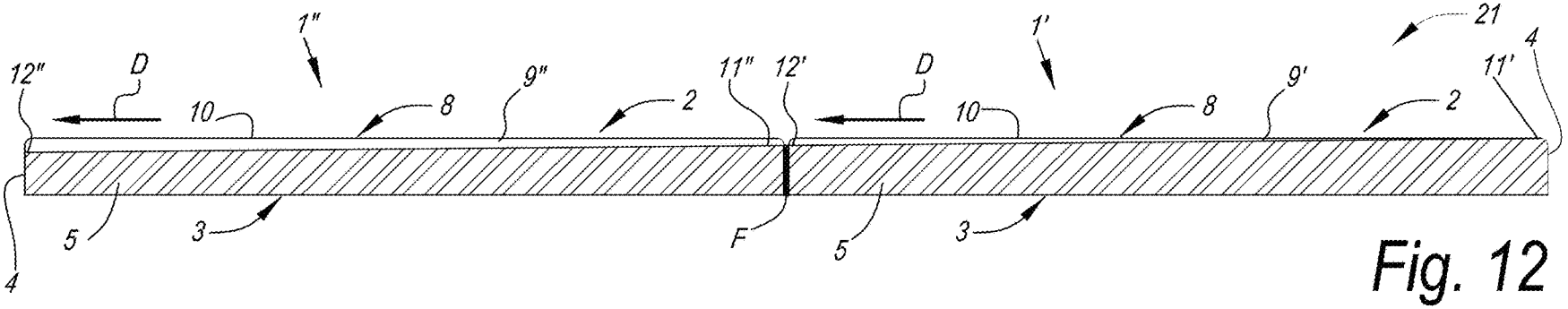
FIG. 12 is an enlargement of the cross section taken through the plane XII-XII of FIG. 11.

By way of example, in FIG. 12 the covering elements 1.1' of the set 21 are laid on the underlying surface 19, by means of suitable adhesives for example.

The covering elements 1, 1' of the set are such that, when two of said covering elements 1, 1' are adjacent, the relief structures 8 are in fluid communication with one another.

FIG. 12 is an enlargement of the cross section taken through the plane XII-XII of FIG. 11.

The side edges 4 of two adjacent covering elements 1', 1" are separated by a drain F formed by a filler. In other embodiments, the side edges 4 of the covering elements 1', 1" may be placed in contact with one another, substantially without any drain F.

In the example, the set 21 comprises a first covering element 1', whose excavations 9', in the form of transverse grooves, each comprise a first and a second end 11', 12' open at the longitudinal edges 4. Similarly, a second covering element 1' comprises excavations 9", in the form of transverse grooves, each having a first and a second end 11", 12" open at the longitudinal edges 4.

The first end 11" of the excavations 9" of the second covering element 1" is located at a level substantially higher or lower than the level at which the first end 11' of the excavations 9' of the second covering element 1' is located, so that the water can flow in the direction of advance D, in a substantially continuous way, between the relief structures 8 of the covering elements 1', 1" of the set 21.

The present invention is not in any way limited to the embodiments described above, and said covering elements and systems may be constructed according to different variants without thereby departing from the scope of the present invention.

The invention claimed is:

1. A set comprising a plurality of covering elements, each covering element of the plurality of covering elements being a ceramic tile comprising:

a support made of a ceramic material;

an upper surface comprising a glaze covering, each of the upper surface and the glaze covering having a relief structure; and a plurality of edges, a lower surface comprising a second relief structure that is substantially specular to the relief structure of the upper surface, the lower surface being free from the glaze covering, wherein the relief structure comprises a plurality of excavations comprising a bottom surface and a depth, wherein the relief structure comprises a wood pattern or a stone pattern;

wherein the depth of the excavations decreases towards at least an edge of the covering element, and wherein the set comprises a plurality of supporting elements configured to support the plurality of covering elements in a raised position relative to a surface to be covered, forming a cavity between the plurality of covering elements and the surface to be covered.

2. The set according to claim 1, wherein one or both of the plurality of covering elements and the plurality of supporting elements are configured so that, in use, a mutual distance, or passage space, allowing access to the cavity is formed between adjacent covering elements of the plurality of covering elements.

3. The set according to claim 2, wherein the plurality of supporting elements comprise at least one spacer configured to be interposed between the edges of two adjacent covering elements of the plurality of covering elements so as to define the mutual distance.

4. The set according to claim 1, wherein the excavations have a depth that decreases from a first edge of the covering element towards an opposite edge of the covering element.

5. The set according to claim 1, wherein the excavations have a depth that decreases from a central portion of the upper surface towards the edges of the covering element.

6. The set according to claim 1, wherein the excavations are interconnected with each other.

7. The set according to claim 1, wherein the relief structure further comprises tops placed substantially at a same height, and wherein the tops define a walkable plane.

8. The set according to claim 1, wherein the excavations have a maximum depth greater than 0.5 mm.

* * * * *